United States Patent [19]

Goldsberry et al.

[11] 4,154,308

[45] May 15, 1979

[54] LOW TORQUE AUTOMATIC SCREWDRIVER

[75] Inventors: Emory G. Goldsberry, Pasadena; Richard E. Eckman, Houston, both of Tex.

[73] Assignee: Dresser Industries, Inc., Dallas, Tex.

[21] Appl. No.: 844,953

[22] Filed: Oct. 25, 1977

[51] Int. Cl.[2] ..... B25B 23/14

[52] U.S. Cl. ..... 173/12; 192/150

[58] Field of Search ..... 173/12; 24/97; 192/150

[56] References Cited

U.S. PATENT DOCUMENTS

| | | | |
|---|---|---|---|
| 833,867 | 10/1906 | Blake | 24/97 |
| 1,026,153 | 5/1912 | Degner | 24/97 |
| 1,333,228 | 3/1920 | Stuart | 24/97 |
| 3,766,990 | 10/1973 | Eckman et al. | 173/12 |
| 4,071,092 | 1/1978 | Wallace | 173/12 |

*Primary Examiner*—Robert A. Hafer

*Attorney, Agent, or Firm*—Roy L. Van Winkle; John N. Hazelwood

[57] ABSTRACT

A pneumatic powered screwdriver adapted for moderately high speed operation and automatic shutoff at relative low torque turning resistance. An axially disengageable clutch unit intermediately couples the motor drive to the output drive bit. Contained in the clutch unit is an improved shutoff and reset mechanism which is cam shifted radially in response to clutch disengagement for enabling air supply interruption to the motor and automatically and positively reset for enabling subsequent operation.

4 Claims, 12 Drawing Figures

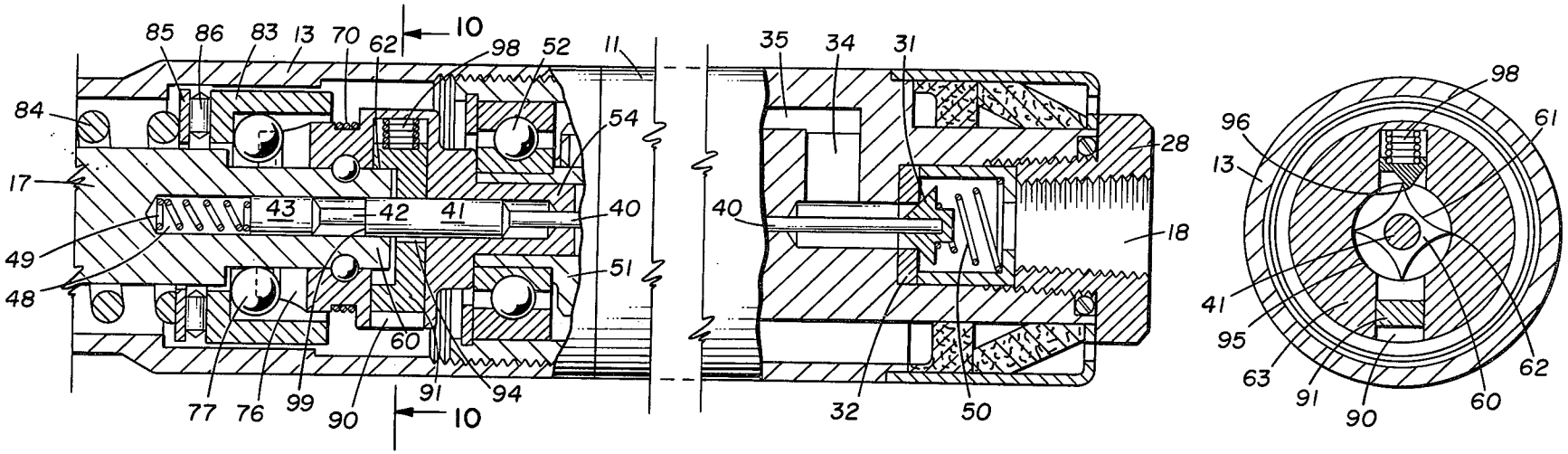
FIG. 10
FIG. 9
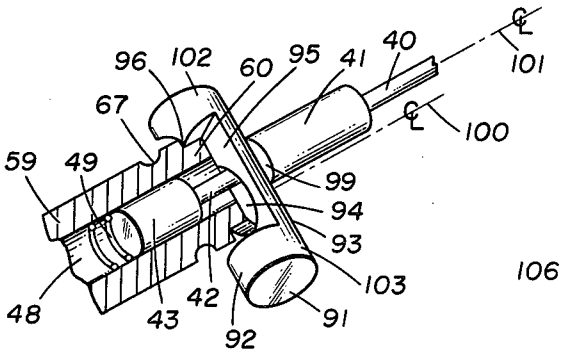
FIG. 11
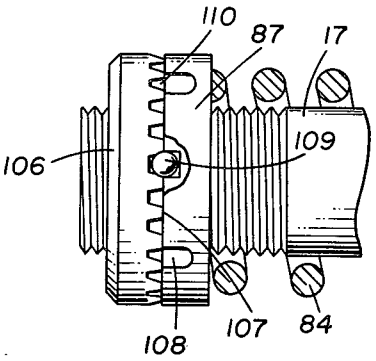
FIG. 12
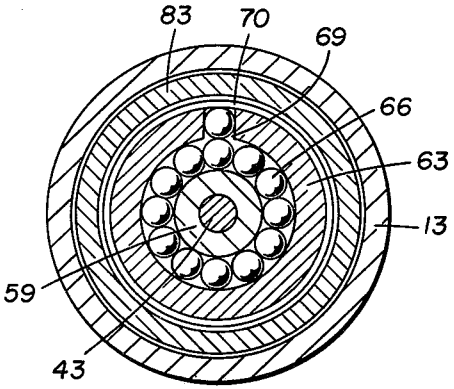
FIG. 5

LOW TORQUE AUTOMATIC SCREWDRIVER

BACKGROUND OF THE INVENTION

This invention relates generally to pneumatically powered screwdrivers of the automatic shutoff type. More particularly, this invention relates to an improved shutoff and reset mechanism for such screwdrivers.

Powered screwdrivers of various types and capacities are well-known and have been commercially used for many years. Popular among consumers of such tools are those specifically adapted to interrupt the power supply for automatic shutoff in contrast to those which slip or ratchet on encountering a turning resistance of preset torque value. Marketed tools exemplifying the shutoff type are disclosed in U.S. Pat. Nos. 2,964,151; 2,986,052; and 3,242,996, all of which have met with a large measure of commercial success.

While fundamentally similar in purpose, construction of the aforementioned shutoff tools is sufficiently different in order to render each of them operationally suitable for their specific use applications. As might be expected, tools suitable for torque sensitivity on the order of 40 inch pounds and above are substantially bulkier and heavier than such tools suitable for delicate work requiring torque sensitivities on the order of 11 inch pounds and below. Moreover, by virtue of their respective constructions, the higher torque tools are generally capable of high speed operation on the order of 3,000 rmp whereas the low torque tools have heretofore been subject to speed sensitivity causing them to endure low speed limitations on the order of 1,000 rmp. Where used for mass production assembly, tool speed is regarded as a significant factor in contributing toward the rate of production output. Consequently, it has long been desired to increase the speed of low torque tools, yet retain their compactness and light weight features compatible with use on delicate type work.

This invention is an improvement to the tool of U.S. Pat. No. 3,766,990. Occasionally, in the tool of that patent, the shaft would stop rotating when the clutch balls were on top of the cam lobes and with the release sear or pin apex engaging one of the points on the shaft end so that the supply valve could not be reopened to restart the tool until the balls and cam were repositioned manually. Such an occurrence did not affect the operational capability of the tool, but was an inconvenience that, in some instances, resulted in increased production time.

An object of the invention is to provide an improved powered screwdriver of the automatic shutoff type that also has a positive automatic reset capability.

Another object of the invention is to provide an improved reset mechanism for use in low torque powered screwdrivers.

SUMMARY OF THE INVENTION

This invention provides an improved powered screwdriver that includes: an air motor having an inlet at which to receive a source of high pressure supply air; a drive end for work engagement with a fastener member to be rotationally driven; and a clutch operative to couple the output of said motor to said drive end and operative to effectively encouple the drive end from the motor at an encountered fastener turning resistance corresponding to a torque of predetermined value; the improvement comprising an improved disconnect and reset means responsive to uncoupling of the clutch to effect interruption of air supply to the motor, and to reset said screwdriver for subsequent operation. The improved disconnect and reset means including a shutoff valve in the air inlet controlling the motor air supply, a throttle rod for operating the shutoff valve, pin means engageable with the rod for preventing movement of the rod in a direction to close the shutoff valve, rotatable cam means for controlling the position of the pin means, an apex portion on the pin means engageable with the cam means and being offset from the rotational center of the cam means, and biasing means for urging the pin means toward the cam means regardless of the condition of the clutch.

BRIEF DESCRIPTION OF THE DRAWING

The foregoing and additional objects and advantages of the invention will become more apparent as the following detailed description is read in conjunction with the accompanying drawing wherein like reference characters refer to like parts in all views and wherein:

FIG. 5 is a cross-sectional view taken substantially along the line 5—5 of FIG. 4;

FIG. 9 is a view similar to FIG. 7, but showing the tool drive components in post-torqued operational position;

FIG. 10 is a cross-sectional view taken substantially along the line 10—10 of FIG. 9;

FIG. 11 is an enlarged isometric view of a portion of the reset mechanism as enclosed within the dash outlined portion of FIG. 4; and FIG. 12 is an enlarged elevational view of the torque-adjusting mechanism as seen from the position 12—12 of FIG. 1.

DETAILED DESCRIPTION OF THE PREFERRED EMBODIMENT

Figure 1:
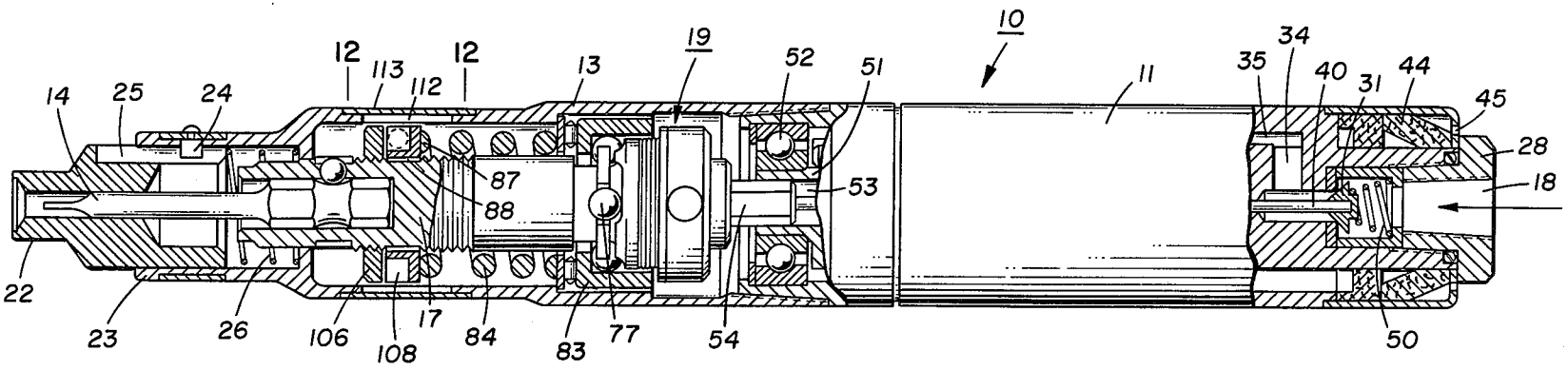
FIG. 1 is a longitudinal view partially in cross-section of a tool constructed in accordance with the invention.
Figure 3:
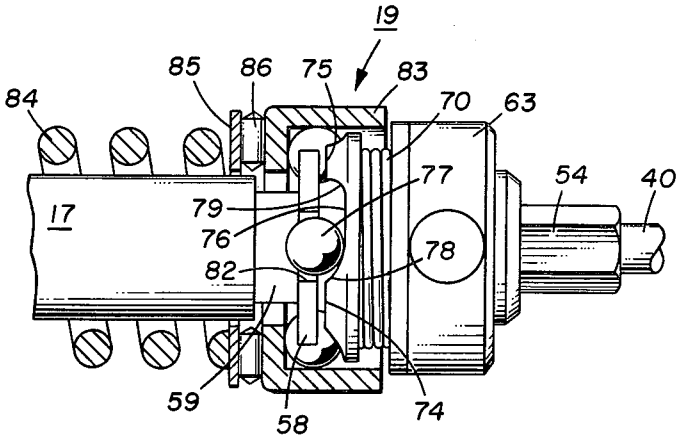
FIG. 3 is an enlarged fragmentary view, partially in cross-section of the clutch mechanism of the tool of FIG. 1.
Figure 2:
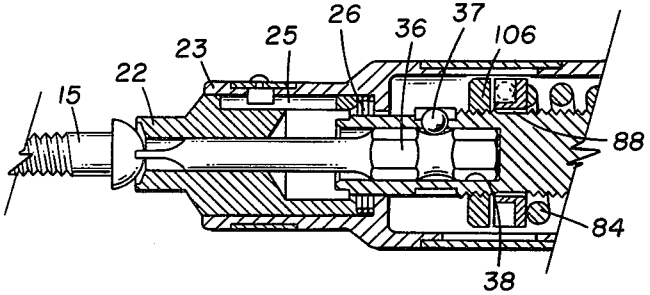
FIG. 2 is a fragmentary longitudinal cross-sectional view of the tool of FIG. 1 with the various parts in one operational position.
Figure 6:
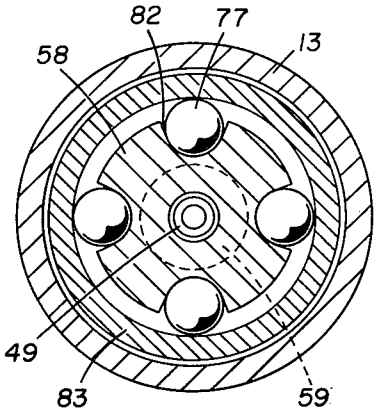
FIG. 6 is a cross-sectional view taken substantially along the line 6—6 of FIG. 4.
Figure 4:
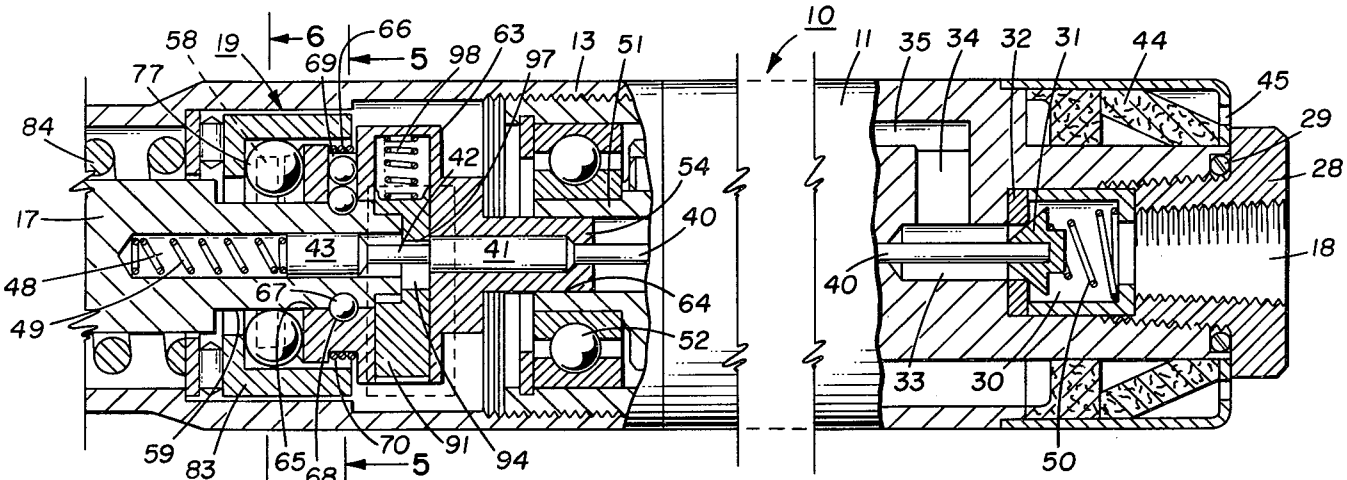
FIG. 4 is an enlarged, fragmentary cross-section through the tool drive corresponding to FIG. 1.

Referring now to the drawings and specifically to FIGS. 1 and 2, the pneumatic tool of this invention is generally comprised of an elongated longitudinal housing that includes a rear section 11 which encloses the drive components. The rear section 11 is telescopically threaded to a front section 13 that encloses the work engaging and torque responsive elements of the tool. The front section 13 includes a screwdriver bit or the like 14 secured in an output shaft 17 for rotationally driving a screw or other similar type fastener 15. It is understood of course that various forms of bits can be substituted for that shown as required, including but not limited to Phillips head, Allen head, socket, etc. Power for driving the tool is furnished by a conventional vane-type pressure fluid motor (not shown) contained in the housing section 11. The motor is supplied with high pressure air through an inlet 18. The motor output is transmitted to the screwdriver bit 14 via an intermediate clutch mechanism 19 that will be described.

Actuation of the tool is initiated by engaging guide piece 22 with screw 15. The guide piece 22 is slidably contained within a necked-down work end 23 of the housing section 13. A key 24 is arranged to prevent rotation of the guide piece relative to work end 23 and to permit the guide piece to slide inwardly relative thereto. Inward movement is opposed by a coil spring 26 and is limited in both directions by the length of a key slot 25 as can be best understood by comparing the guide piece positions in FIGS. 1 and 2. Inward movement of the guide piece 22 permits the bit 14 to engage the screw 15. The bit 14 includes a bit shank 36 that is releasably connected by a ball-detent 37 to the output shaft 17 in the bore 38. Continued inward movement thereof also moves the clutch 19 and a throttle rod 40.

For a more detailed understanding of the various operating components, attention is now directed to FIGS. 3–8. As shown therein, the air inlet 18 is contained in a connector 28 that is screw threaded to the rear of the housing section 11. A pressure tight seal between the connector 28 and housing section 11 is provided by an O-ring seal 29. Fluid pressure admitted through the connector 28 is communicated into an enclosed chamber 30 wherein the pressure acts upon the back face of a conically-shaped throttle and shutoff valve 31. The shutoff valve 31 is engageable with an annular valve seat 32 to prevent fluid flow into a chamber 33 which is connected by a passage 34 to a motor inlet port 35. Opening and closing of the valve 31 is governed by the axially slidable throttle rod 40 which is diametrically enlarged at 41, reduced again at 42 and enlarged again at 43. The end 43 is received in an axial bore 48 of the output drive shaft 17. A coil spring 49 in the bore 48 urges the rod 40 in one direction in opposition to the action of a compressed coil spring 50 located in the chamber 30. The spring 50 also acts against the back face of valve 31. Air exhaust from the motor is through a muffler 44 and exhaust ports 45.

The motor is connected to a planetary gear train (not shown) the output of which is represented by a shaft 51 journaled in a ball bearing 52. The shaft 51 includes a central axial bore 53 of hexagonal cross-section which slidably receives a hexagonal input stub shaft 54 of the clutch 19 for a rotational driving interlock therebetween. The ciutch output, as will be described below, is transmitted through a radially extending annular flange 58 that is integral with a rearward reduced diameter portion 59 of shaft 17. An end 60 of the shaft portion 59 is of special cam configuration as can best be seen in FIGS. 8 and 10. As shown therein, the cross section of the end 60 somewhat resembles a four-pointed star having slightly concave sides 61. The end 60 extends inwardly of the clutch 19.

To rotatably couple the output shaft 17 to the motor, the clutch 19 includes a body 63. The body 63 has a central bore 64 in which is slidably received the section 41 of the throttle rod 40. A counterbore 65 in the body 63 receives the shaft portion 59 of the output shaft 17. The body 63 and shaft 17 are axially coupled but free for relative rotation since the connection therebetween is provided by a plurality of small diameter balls 66. The balls are located in an annular groove 67 in the shaft 17 and in a corresponding annular groove 68 in the body 63. A radial bore 69 in the body 63 permits placing the balls 66 in the grooves. The balls 66 are retained by means of an encircling spiral type spring retainer 70.

To transmit rotation from the motor output shaft 51 to the shaft 17, the leftward end of the clutch 19 (as viewed in the drawing) includes a cam 74 having a plurality of lobes 75. The lobes 75 extend axially leftward facing toward shaft 17 at angularly displaced intervals radially outward of the shaft. Between adjacent lobes 75, the cam 74 is axially recessed at 76 to receive hardened steel balls 77. At its circumferential ends, each recess 76 forms a rise 78 of gradual pitch effective for screw tightening and an opposite rise 79 of comparatively steeper pitch effective for reverse tool operation as for untightening of a screw or the like. The balls 77, in turn, extend axially inward of a plurality of radially open slots 82 formed in a shaft flange 58. The slots 82 are angularly matched to the location of cam recesses 76.

For radially confining the balls 76 while maintaining coupling engagement between the cam 74 and the flange 58 there is provided a cup-shaped, ball cage or retainer 83 constantly urged axially rearwardly by a coil spring 84. The spring 84 encircles a portion of the shaft 17 and has one end engaging a race or follower 85, which is part of a thrust bearing 86. The thrust bearing 86 is in engagement with the back side of the ball retainer 83. At its opposite end, the spring 84 engages a follower 87 (FIG. 1). The follower 87 is axially slidable relative to the shaft 17, but rotationally secured thereto by means of opposite keys 88.

Figure 8:
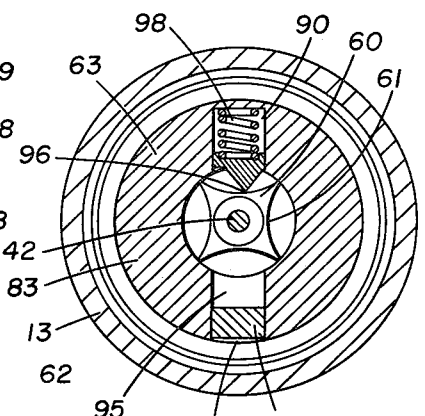
FIG. 8 is a cross-sectional view taken substantially along the line 8—8 of FIG. 7.
Figure 7:
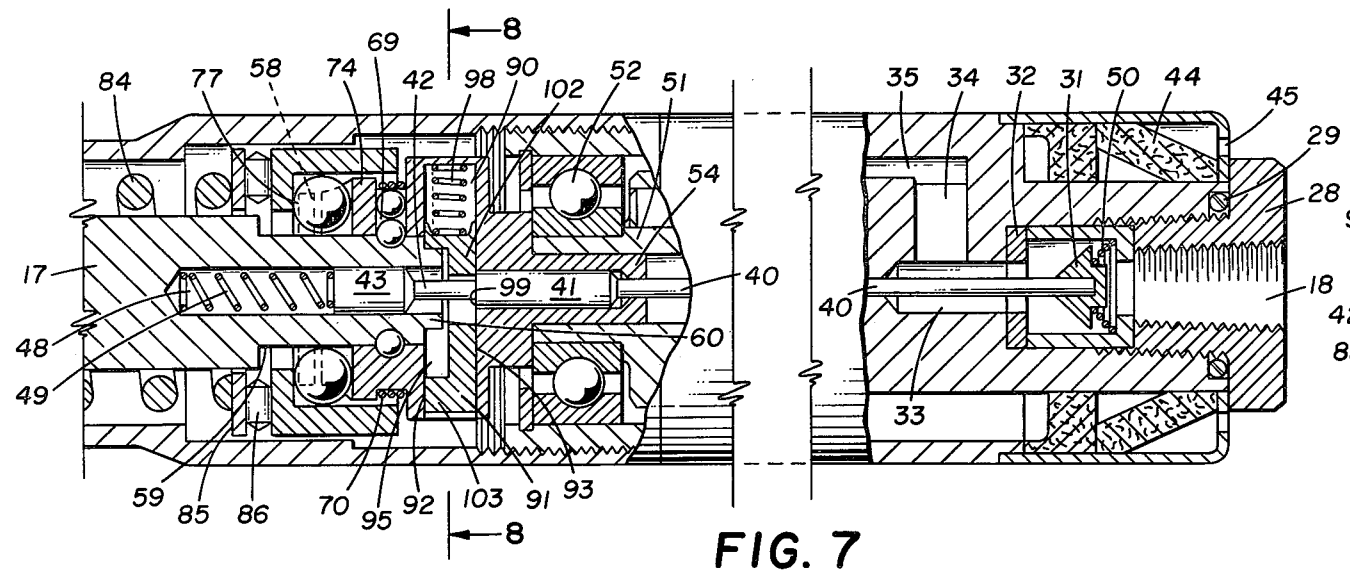
FIG. 7 is a view similar to FIG. 4, but showing the tool drive components in an operative position.

As shown in FIGS. 8 and 10, a radially movable release pin 91 (see also FIG. 11), is located in a radially extending cylindrical cavity 90 of the body 63. The pin 91 is generally cylindrical and geometrically formed so that its centroid 100 is radially displaced from the rotational tool axis 101. To achieve centroidal displacement, the pin 91 includes a relatively small top mass 102 and a comparative larger bottom mass 103. Likewise, as arranged, the pin 91 includes side faces 92 and 93 and a lateral slot 94 that extends axially parallel to the tool axis 101. The slot 94 is sized, when appropriately positioned, to slidably pass throttle rod diameters 41 and 42. Located inwardly of the face 92 is a slot cutout 95 (See FIG. 10) that is V-shaped at its top forming an apex 96 that is urged toward the shaft end 60 by a coil spring 98. The apex 96 is located on the pin 91 in a position that is parallelly displaced relative to the centerline of the generally cylindrical pin 91 and from the tool rotational centerline or tool axis 101.

With the tool at rest, or at low speed, the pin apex 96, by virtue of force exerted by the spring 98, remains engaged with a side 61 of shaft end 60. This places a short portion 97 (see FIG. 4) of a side face 93 of the pin 91 in engagement with a radial end face 99 on the throttle rod portion 41, thus, precluding any leftward movement of the throttle rod 40. With the pin mass center 100 being eccentrically located with respect to the apex 96 and relative to the tool axis 101, centrifugal force generated by tool rotation acts continuously in a direction aiding spring 98 for maintaining apex 96 in engagement with the side 61 of the shaft end 60.

It is also important to note that the points 62 of the end 60 of the shaft 17 are arranged with respect to the cam 74 and apex 96 so that when the balls 77 are located on the lobes 75, the points will have moved past the apex 96 as shown in FIG. 10. Thus, the pin 91 is free to return, under the urging of the spring 98, to the position shown in FIG. 4 since the apex 96 is adjacent one of the concave sides 61.

In order to preset the torque value at which clutch disengagement is to be effected, there is provided an adjustment nut 106 as seen in FIGS. 1 and 12, that is screw threaded onto the shaft 17. The nut 106 has a serrated radial end 107, facing toward angularly displaced pockets 108 in the back side of the spring follower 87. Contained in the uppermost pocket is a hardened steel ball 109 adapted to normally seat in a serration valley 110 of the face of the nut 106. A slot 112 is formed in the housing section 13 in the vicinity of the nut 106 providing access to the nut 106 whereby a Phillips screwdriver end or the like can be inserted into an adjacent nut serration. Rotating the nut 106 in either direction will threadably advance or withdraw the nut along shaft 17. This varies the force required to compress the spring 84 to maintain the desired coupling force that must be overcome in effecting clutch disengagement between the shaft flange 58 and clutch cam 74. A rotatably displaceable spring clip 113 normally covers the slot 112 and can be rotated for exposing the nut 106 to perform the adjustment just described.

In operation, the tool is supplied by a flexible conduit or the like (not shown) with high pressure air from a suitable source connected to the inlet 18. On pressing guide piece 22 against a fastener such as the screw 15, the tool is automatically centered on the fastener while the guide piece 22 is caused to slide axially rearward to permit the fastener to be engaged by the screwdriver bit 14. Continued force thereon moves the screwdriver bit carrying the drive shaft 17, clutch 19 and the operating components secured thereto rearwardly. Simultaneously, the same rearward movement forces the throttle valve rod 40 rearward to open valve 31 whereby fluid pressure in chamber 30 is admitted to chamber 33, passage 34 and motor inlet port 35 for energizing the motor.

With the motor operating, its output shaft 51 is caused to rotate and, through its connection with stub shaft 54, rotation is transmitted to the clutch 19. Due to force imposed by the spring 84, the clutch balls 77 are restrained against the rise of cam pitch 78 and thereby transmit a driving force through the flange 58 to the output shaft 17 and bit 14 connected thereto.

When the screw 15 reaches its intended torque, the turning resistance exerted by the bit 14 while the motor continues operative, causes relative rotation between the cam 74 and flange 58 forcing the balls 77 axially outwardly on cam rises 78. With relative rotation occurring between the clutch 19 and shaft 17, the pin 91 is shifted radially by the engagement of the corner 62 of the shaft 17 with the pin apex 96. The pin 91 is repositioned in cavity 90 by the radial movement until the slot 94 therein is more nearly axially coincident with the section 41 of the rod 40 permitting axial leftward movement of the throttle rod 40. With axial throttle rod interference removed, fluid force acting against the shutoff valve 31 aided by the force of the spring 50 urges the valve in opposition to spring 49 and into its shutoff position against the valve seat 32. Fluid flow to the motor is immediately interrupted and tool rotation ceases. Upon removal of the tool from screw 15, the reacting spring forces restore the various components to their startup condition.

Sometimes, the momentum of the rotating parts of the tool is such that at shutoff, the balls 77 land on the flat end portions of the lobes 75 of the cam 74. When this occurs and when the shaft 17 stops with the corner 62 thereon in engagement with the pin apex 96 of the tool shown in U.S. Pat. No. 3,766,990, the pin 91 cannot engage the rod 40. As a result, the valve 31 cannot be opened to restart the tool.

With the improved tool of this invention, the parallel offset of the pin apex 96 and the configuration of the end 60 (with the concave sides 61) cooperate to prevent the pin 91 from remaining in engagement with the corner 62. Thus, and even though the balls 77 do land on the lobes 75, the pin 91 will move radially to a reset position wherein the pin 91 engages the enlarged portion 41 of the rod 40. After the tool is removed from the fastener 15, the spring forces cause movement of the shaft 17 and clutch 19 relatively to the left so that re-engagement with the next fastener to be tightened causes movement of the rod 40 to the right, reopening the valve 31 since the pin 91 is in engagement with enlarged portion 41 of the rod 40.

The foregoing detailed description sets forth a power screwdriver adapted for automatic shutoff on reaching a predetermined torque value at which the tool is preset to operate. The novel clutch construction described renders the tool readily capable of operating at low torque values without speed sensitivity in the manner of such tools of the prior art. To the contrary, by means of a pin disconnect having a centroid offset from the rotational axis, tool rotation is exploited to aid rather than impair engagement until such time as desired torque resistance is encountered. Consequently, a tool manufactured as described achieves these results while retaining basic compactness and light weight features characteristic of such tools for delicate work suitability. At the same time, the tool positively and automatically resets thereby avoiding production delays. Despite the improvements afforded hereby, these features are affected in a highly economical manner by use of relatively simple and inexpensive components.

Since many changes and modifications can be made to the specific embodiment of the invention described hereinbefore without departing from the spirit of the invention, it is intended that such description shall be interpreted as illustrative of the invention and not in a limiting sense.

The embodiments of the invention in which an exclusive property or privilege is claimed are defined as follows:

1. In an improved powered screwdriver including an air motor having an inlet at which to receive a source of high pressure supply air; a drive end for work engagement with a fastener member to be rotationally driven; and a clutch operative to couple the output of said motor to said drive end and operative to effectively uncouple the drive end from the motor at an encountered fastener turning resistance corresponding to a torque of predetermined value; the improvement comprising an improved disconnect and reset means responsive to uncoupling of the clutch to effect interruption of the air supply to the motor and to reset the screwdriver for subsequent operation, said improved disconnect and reset means including:

a shutoff valve in the air inlet adapted to open and close the air supply to the motor;

a slidable throttle rod for operating said shutoff valve between its open and closed positions;

pin means having an axis of movement which intersects the axis of tool rotation, and movable radially relative to the axis of tool rotation between a first position engaging said throttle rod for preventing movement of said throttle rod in a direction to close said valve and a second position out of engagement with said throttle rod permitting said rod movement for closing said valve;

cam means rotatable with said drive end including at least one radially disposed point for shifting said pin means from said first to said second position;

said pin means including an apex portion for engaging said cam means, said apex portion being offset from said axis of movement of pin means; and biasing means for urging the apex portion of said pin means toward said cam means and toward said first position regardless of the operative condition of said clutch.

2. In the improved powered screwdriver of claim 1, wherein said pin means is generally cylindrical and is supported for radial movement with its axis intersecting the axis of said tool and with said apex portion definitively located to one side of said axes.

3. In the improved powered screwdriver of claim 2, wherein:

said pin means has an elongated slot extending therethrough in a direction parallel to the axis of said tool with said apex portion projecting toward said slot;

said throttle rod is supported on the axis of said tool and extends through the slot in said pin means; and said cam means has a bore therethrough slidably receiving said throttle rod and has at least one cam surface thereon engageable with said apex portion for moving said pin means radially permitting movement of said throttle rod to close said valve, said cam means including concave sides permitting said pin means to return to a rod engaging first position.

4. In the improved powered screwdriver of claim 1, wherein the clutch includes a plurality of circumferentially-spaced lobes and recesses and a clutch ball in each recess, wherein a flange operatively connected with the drive end includes a circumferentially-spaced recess aligned with each recess of the clutch, and wherein said cam means includes a plurality of points circumferentially spaced by concave sides and angularly arranged with respect to the lobes whereby said apex portion will be adjacent one of said concave sides when the clutch balls are located on said lobes.

* * * * *